US005697722A

United States Patent [19]

Hladik et al.

[11] Patent Number: 5,697,722

[45] Date of Patent: Dec. 16, 1997

[54] RING BINDER MECHANISM HAVING SPRING CLOSURE MECHANISM

[75] Inventors: Herta Hladik, Pölleritzergasse 6/20/8/49, Wien; Hans Igler, Vienna, both of Austria

[73] Assignee: Herta Hladik, Vienna, Austria

[21] Appl. No.: 640,904

[22] PCT Filed: May 16, 1995

[86] PCT No.: PCT/AT95/00095

§ 371 Date: Apr. 19, 1996

§ 102(e) Date: Apr. 19, 1996

[87] PCT Pub. No.: WO95/31339

PCT Pub. Date: Nov. 23, 1995

[30] Foreign Application Priority Data

May 17, 1994 [AT] Austria ..... 1015-94

[51] Int. Cl.[6] ..... B42F 13/24

[52] U.S. Cl. ..... 402/35; 402/34; 402/69; 402/70

[58] Field of Search ..... 402/35, 34, 31, 402/42, 70, 71, 72, 73, 69; 281/21.1, 27.1, 27.2

[56] References Cited

U.S. PATENT DOCUMENTS

| | | | |
|---|---|---|---|
| 436,533 | 9/1890 | Merk | 402/35 X |
| 1,180,849 | 4/1916 | Hill | 402/69 |
| 1,705,306 | 3/1929 | O'Neil | 402/73 X |
| 3,104,667 | 9/1963 | Mintz | 402/75 |
| 3,762,823 | 10/1973 | Gregson | 402/70 X |
| 3,785,740 | 1/1974 | Strong | 402/34 X |
| 4,009,599 | 3/1977 | Patriquin | 70/90 |
| 5,509,745 | 4/1996 | Hegarty | 402/70 X |

FOREIGN PATENT DOCUMENTS

| | | | |
|---|---|---|---|
| 973769 | 9/1975 | Canada | 402/69 |
| 36856 | 1/1886 | Germany . | |
| 3614008 | 10/1987 | Germany | 402/69 |
| 1413159 | 11/1975 | United Kingdom | 402/71 |

*Primary Examiner*—Daniel W. Howell
*Assistant Examiner*—Julie A. Krolikowski
*Attorney, Agent, or Firm*—Jacobson, Price, Holman & Stern, PLLC

[57] ABSTRACT

A ring binder mechanism has a base plate that may be mounted in a binder or the like and preferably two spring closure mechanisms that each comprise a filing pin and a tube perpendicularly secured to the base plate. A longitudinally sliding and rotary closing bow is mounted in the tube to open and close the mechanism. A pressure spring is mounted between a disk-shaped bulge of the closing bow and a closed end of the robe to generate a closing force in the direction of the filing pin.

5 Claims, 4 Drawing Sheets

RING BINDER MECHANISM HAVING SPRING CLOSURE MECHANISM

The present invention relates to a ring binder mechanism with a base plate mountable in a binder or ring binder and at least one spring closure mechanism consisting of a filing pin and a tube, both being perpendicularly secured to the base plate, a closing bow being mounted slidingly in longitudinal direction and being rotatable to open and close the mechanism, and a spring acting on the closing bow.

Such a ring binder mechanism has become known from German patent DE-C 36 856. The tube shows an inner diameter corresponding to the outer diameter of the closing bow. In the tube a compression spring is provided, which is mounted between the base plate and the one end of the closing bow arranged in the tube. On the closing bow there is arranged a pin engaging with a Z-like guiding slot on the tube. Therewith the movement of the closing bow is guided when being opened and closed on the one hand, whereas the closing bow is held in its closed position against the closing force of the spring.

Disadvantageously the compression spring is biased in the opening direction. Thereby there always exists the risk that the closing bows open by an unintentional rotation and are left open by the compression force of the spring.

Common to other known systems is the absence of the guiding slot in the tubular part. This known ring binder mechanisms comprises a relatively complicated construction comprising several component parts. Also increased expenditures for assembling are necessary.

The invention aims at providing a new ring binder mechanism, which avoids the above-mentioned drawbacks of the known ring binder mechanisms, has a simple design, requires reduced expenditures for assembling and can be easily handled.

This aim is achieved with the inventive ring binder mechanism in that the tube is provided with an inner diameter being greater than the diameter of the closing bow, in that the end of the tube being opposite to the base plate is closed, in that the closed part is provided with a bore, through which the closing bow is guided and whose diameter corresponds to the outer diameter of the closing bow, in that the closing bow further comprises a preferably disk-shaped bulge, whose diameter corresponds to the inner diameter of the tube, and in that a pressure spring is mounted between the bulge and the closed part to generate a closing force in the direction of the filing pin.

The invention is described in detail with the aid of the drawings.

Figure 1:
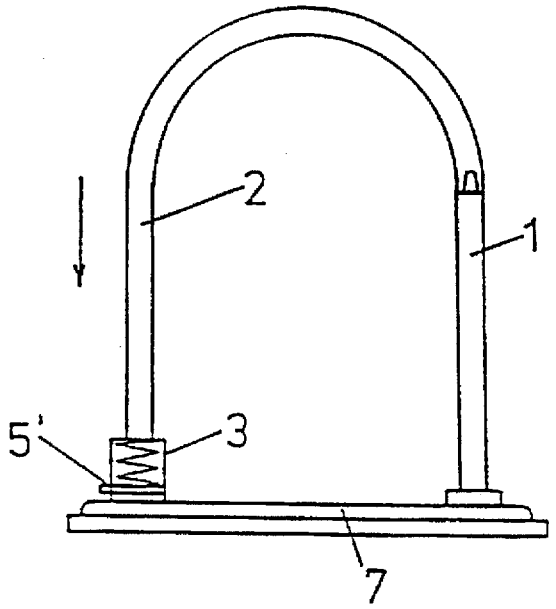
FIGS. 1 and 2 show ring binder mechanisms in closed state.
Figure 2:
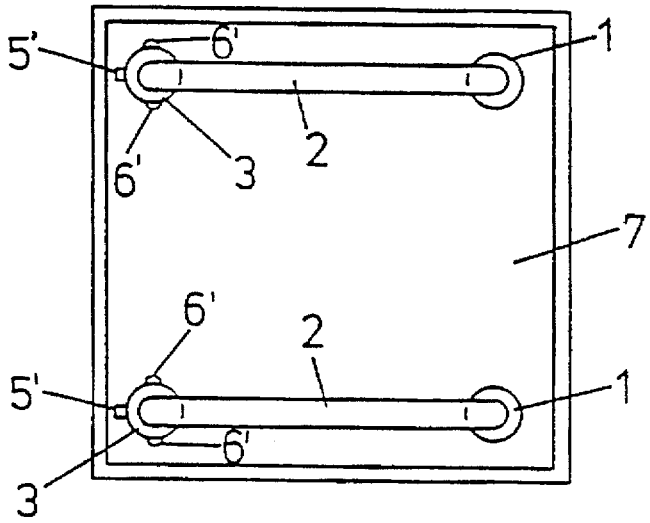
Figure 3:
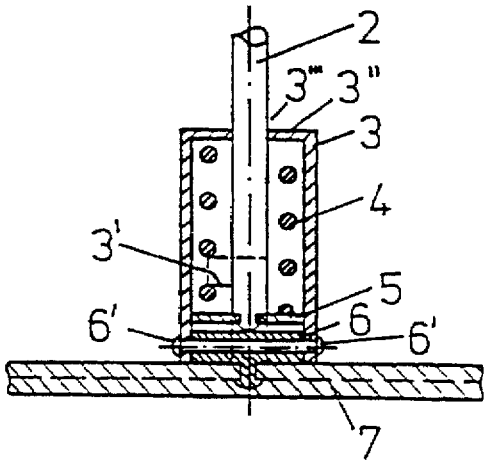
FIG. 3 is the schematic sectional view of the spring system in closed state.

The inventive ring binder mechanism consists preferably of two spring closure mechanisms mounted on a common base plate 7. The spring closure mechanism consists of a filing pin 1 and a tube 3 both being perpendicularly secured to the base plate 7, as well as a closing bow 2 being mounted slidingly in longitudinal direction and being rotatable in the tube 3 to open and close the mechanism, and a pressure spring 4 being mounted between a disk-shaped bulge 5 of the closing bow 2 and the closed part 3" of the tube 3 to generate a closing force in the direction of the filing pin 1.

The tube 3 is fastened to an annular support disk 6 by a screw or rivet 6'. The disk 6 is fastened on the base plate 7 by riveting.

Preferably the disk-shaped bulge 5 of the closing bow 2 is provided with a projection 5' and there is provided a guiding slot 3' in the tube 3, with which engages the projection 5' and which guides the movement of the closing bow 2 during opening and closing. The guiding slot 3' consists of an element being arranged along and thereafter perpendicularly to the tube 3.

Figure 4:
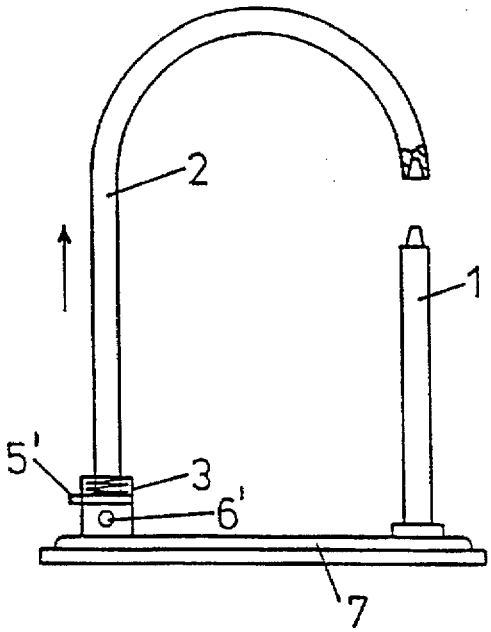
FIGS. 4 and 5 show the ring binder mechanism in open state.
Figure 5:
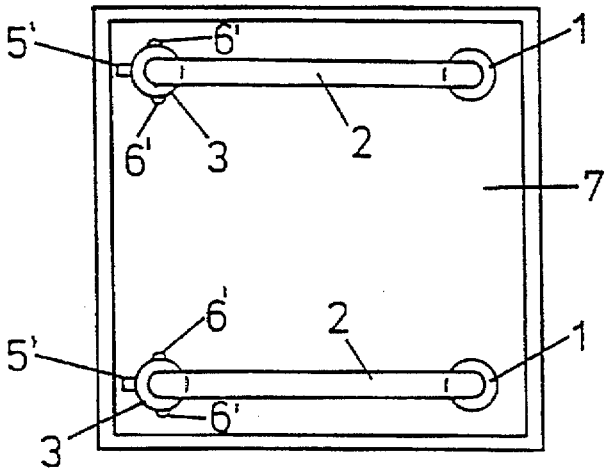
Figure 6:
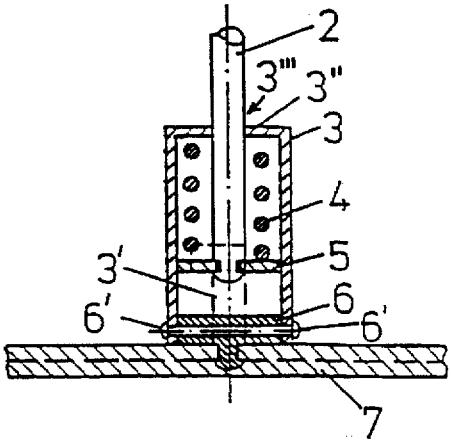
FIG. 6 is the schematic sectional view of the spring system in open state.
Figure 7:
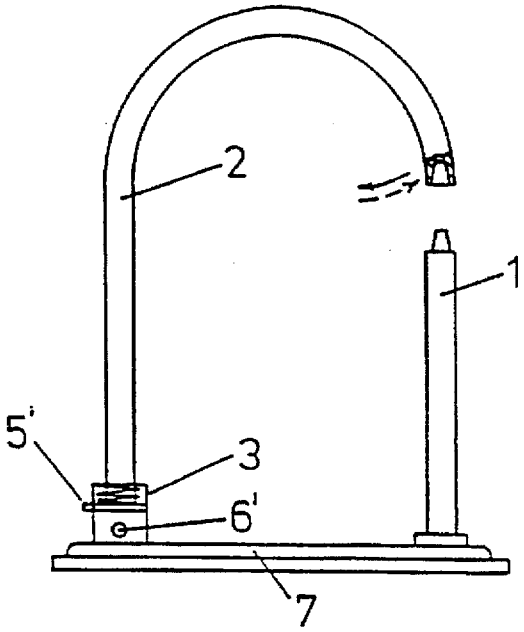
FIGS. 7 and 8 show the ring binder mechanism in open state, wherein the closing bows are in a rotated position.
Figure 8:
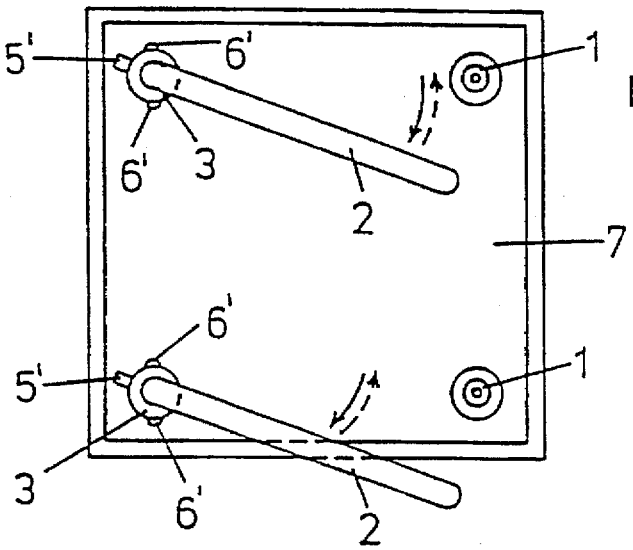
Figure 9:
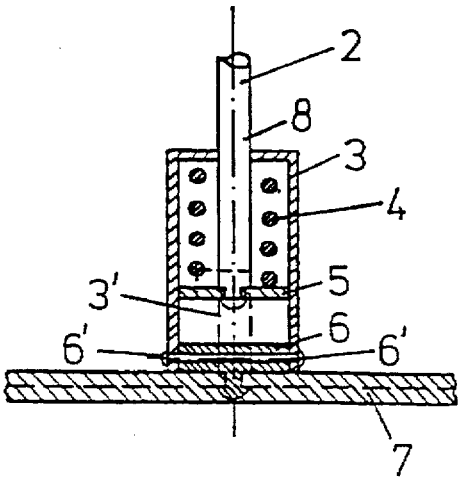
FIG. 9 is the schematic sectional view of the spring system in open state with a rotated position of the closing bow.
Figure 10:
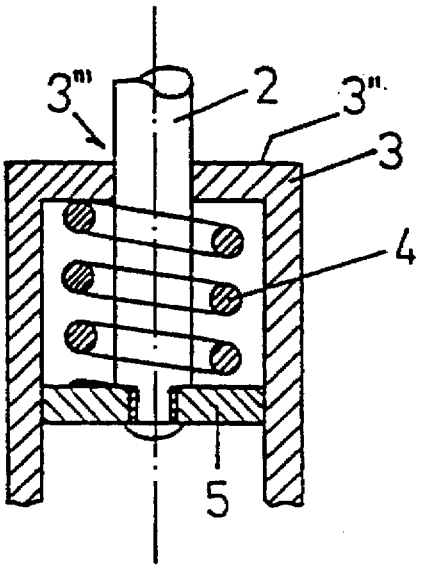
FIGS. 10 to 12 are enlarged views of the tube with inserted pressure spring between the closed part of the tube and the disk-shaped bulge at the end of the closing bow as well as of the fixation of the tube on the base plate.
Figure 11:
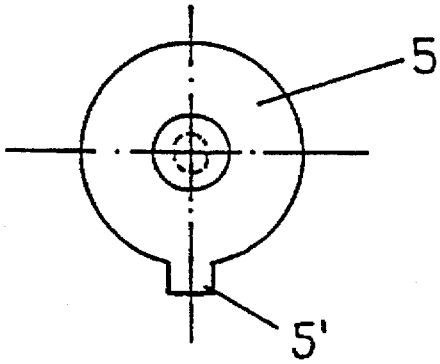
Figure 12:
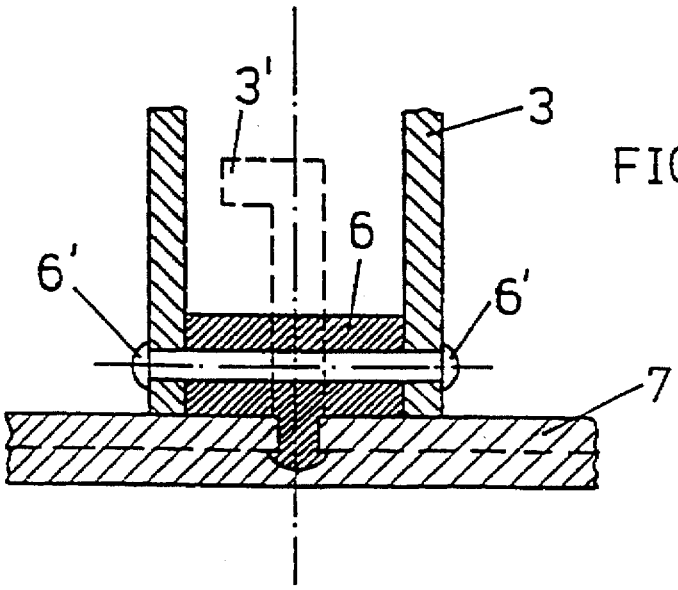

The closed spring closure mechanism (FIG. 1, 2, 3) is opened according to the following:

First the closing bow 2 is raised against the force of the pressure spring 4 in longitudinal direction until the projection 5' hits the end of the longitudinal part of the guiding slot 3' (FIG. 4, 5, 6) and is thereafter (FIGS. 7, 8, 9) rotated until the projection 5' hits the end of the part of the guiding slot 3' being perpendicular to the tube 3. Thereby the closure mechanism is not only opened, but the closing bow 2 is held against the force of the pressure spring in its heightened position.

A filing of loose sheets onto the filing pin 1 is now possible without problems.

The closing of the opened spring closure mechanism (FIG. 7, 8, 9) of the ring binder mechanism is performed correspondingly in reverse sequence:

The closing bow 2 is rotated in the reverse rotating direction until the part of the guiding slot 3+ of the tube 3 running in longitudinal direction.

Under the force of the pressure spring 4 the closing bow 2 is lowered, guided by the projection 5' of the disk-shaped bulge 5 and the part of the guiding slot 3' running in longitudinal direction, and closes under pressure in alignment with the filing pin 1 of the spring closure mechanism.

We claim:

1. Ring binder mechanism comprising:

a base plate mountable in a binder or ring binder, at least one spring closure mechanism including a filing pin and a tube, said filing pin and said tube being seperatedly secured to the base plate in a perpendicular orientation, a closing bow longitudinally slidable and rotatable with respect to said tube to open and close the mechanism, the tube having an inner diameter greater than a diameter of the closing bow, one end of the tube located opposite to the base plate being closed, the closed end being provided with a bore through which the closing bow is guided and whose diameter corresponds to the outer diameter of the closing bow, the closing bow further including a disk-shaped bulge located at an end of the closing bow positioned within the tube, a diameter of the disk-shaped bulge corresponding to an inner diameter of the tube, and a pressure spring located in said tube, mounted between the disk-shaped bulge and the closed end of the tube to generate a bias force on the disk-shaped bulge in a direction of the base plate for forcing an opposite end of the closing bow into contact with the filing pin.

2. Ring binder mechanism according to claim 1, wherein the disk-shaped bulge includes an annular disk fixed on the closing bow.

3. Ring binder mechanism according to claim 1, wherein the disk-shaped bulge includes a projection engaging a guiding slot arranged longitudinally along and terminating in and thereafter extending perpendicularly in the tube, whereby the closing bow performs a longitudinal and rotary movement when being opened and, conversely, a rotary and longitudinal movement, when being closed, as guided by the projection engaging the guiding slot.

4. Ring binder mechanism according to claim 1, wherein the tube is fastened on an annular support disk with a screw or a rivet and the disk is fastened on the base plate by riveting.

5. Ring binder mechanism according to claim 1, wherein two spring closure mechanisms are mounted on the base plate.

* * * * *